US006425443B1

(12) United States Patent
Hill et al.

(10) Patent No.: US 6,425,443 B1
(45) Date of Patent: Jul. 30, 2002

(54) PRESSURE COMPENSATED DISCONNECT SYSTEM AND METHOD

(75) Inventors: Stephen D. Hill, Pearland; James M. Costley, Freeport, both of TX (US); David M. Eslinger, Broken Arrow, OK (US); Mark C. Oettli, Richmond; Randolph J. Sheffield, Missouri City, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/716,986

(22) Filed: Nov. 20, 2000

(51) Int. Cl.[7] ..... E21B 23/00

(52) U.S. Cl. ..... 166/377; 166/242.6; 166/242.7; 285/900

(58) Field of Search ..... 166/242.1, 242.6, 166/242.7, 377, 338, 340, 308; 285/3, 900

(56) References Cited

U.S. PATENT DOCUMENTS

| | | | | |
|---|---|---|---|---|
| 2,228,243 A | | 1/1941 | Baker | |
| 2,839,315 A | | 6/1958 | Arterbury et al. | |
| 3,148,894 A | | 9/1964 | Schwab | |
| 3,331,378 A | | 7/1967 | Gibbs et al. | |
| 3,888,306 A | | 6/1975 | Wetzel | |
| 4,066,282 A | | 1/1978 | Vann | |
| 4,175,778 A | | 11/1979 | Nunez et al. | |
| 4,292,988 A | | 10/1981 | Montgomery | |
| 4,361,165 A | * | 11/1982 | Flory | 137/614.02 |
| 4,449,736 A | | 5/1984 | Blackwell | |
| 4,452,472 A | | 6/1984 | Crase | |
| 4,501,287 A | * | 2/1985 | Thomson | 137/68.15 |
| 4,880,257 A | * | 11/1989 | Holbert, Jr. | 285/2 |
| 4,884,830 A | * | 12/1989 | Meisinger | 285/102 |
| 5,203,374 A | * | 4/1993 | Smith, III | 137/614.04 |
| 5,219,027 A | * | 6/1993 | Taylor | 166/181 |
| 5,947,198 A | * | 9/1999 | McKee et al. | 166/377 |
| 6,142,237 A | | 11/2000 | Christmas et al. | |
| 6,213,206 B1 | * | 4/2001 | Bakke | 166/242.7 |

* cited by examiner

*Primary Examiner*—David Bagnell
*Assistant Examiner*—Brian Halford
(74) *Attorney, Agent, or Firm*—Wayne I. Kanak; Brigitte L. Jeffery; John J. Ryberg

(57) ABSTRACT

A disconnect for facilitating release of a tool at a downhole, wellbore location. The disconnect utilizes an upper portion and a lower portion connected at least in part by a shear member. The disconnect uses a plurality of pressure areas to selectively expose the lower portion to balanced, counteracting axial forces. The pressure areas allow release or disconnection of the upper portion from the lower portion upon application of a predetermined tensile load without subjecting the tubing to an undesirably high tensile load.

25 Claims, 4 Drawing Sheets

$$A_1 = (A_2 - A_4) \qquad P_D A_1 = P_D (A_2 - A_4)$$

$$A_1 = (A_3 - A_4) \qquad P_D A_1 = P_D (A_3 - A_4)$$

PRESSURE COMPENSATED DISCONNECT SYSTEM AND METHOD

FIELD OF THE INVENTION

The present invention relates generally to a technique for delivering high pressure fluids to a downhole location, and particularly to a technique for balancing the pressures acting on a downhole disconnect.

BACKGROUND OF THE INVENTION

Downhole tools for use in a variety of wellbore applications are often connected to a tubing string, such as a coiled tubing string. The tubing may be connected to a tool or tools by a disconnect that permits disconnection of the tool if, for example, the tool becomes stuck in the wellbore. By applying a tensile load or other input, the disconnect releases the tool to permit withdrawal of the tubing. Certain mechanical disconnects are calibrated to release at a preset release load upon application of a sufficient tensile load to the tubing.

In an exemplary application, a high pressure fluid, such as a liquid, is delivered to the tool through the tubing. The internal pressure is greater than the external wellbore pressure and this allows use of the high pressure fluid to perform a variety of tasks, such as cracking of the surrounding formation. However, current mechanical disconnects are not pressure balanced. In other words, the differential pressure between the internal pressure and the external, wellbore pressure causes a force tending to separate the disconnect. This is undesirable, because a sufficiently high pressure differential can cause unexpected release of the tubing from the tool or tools without application of the release load to the tubing. If the preset release load is raised to avoid unexpected release, however, the tensile load required to cause a desired release may exceed the tensile limit of the tubing.

SUMMARY OF THE INVENTION

The present invention relates generally to a system for facilitating disconnection of a tool at a downhole location. The system comprises a tubing and a tool. Additionally, a mechanical disconnect is positioned between the tubing and the tool to permit release of the tool from at least a portion of the tubing. The mechanical disconnect is pressure compensated to ensure release of the tool only upon application of the predetermined tensile load to the tubing.

According to another aspect of the present invention, a mechanical disconnect is provided for use in a downhole environment. The mechanical disconnect includes an upper portion and a lower portion. A shear member is connected between the upper portion and the lower portion. Also, a pressure balance system is utilized. The pressure balance system includes pressure areas exposed to a relatively high internal pressure to balance the axial forces acting on the lower portion.

According to another aspect of the present invention, a method is provided for supplying a fluid under relatively high pressure to a tool disposed downhole in a wellbore. The method comprises pressurizing the fluid in a tubing disposed in a wellbore. The method further comprises directing the fluid through a mechanical disconnect to the tool. Additionally, the method includes pressure balancing the mechanical disconnect to provide counteracting axial forces.

BRIEF DESCRIPTION OF THE DRAWINGS

The invention will hereafter be described with reference to the accompanying drawings, wherein like reference numerals denote like elements, and.

DETAILED DESCRIPTION OF THE EXEMPLARY EMBODIMENTS

Figure 1:
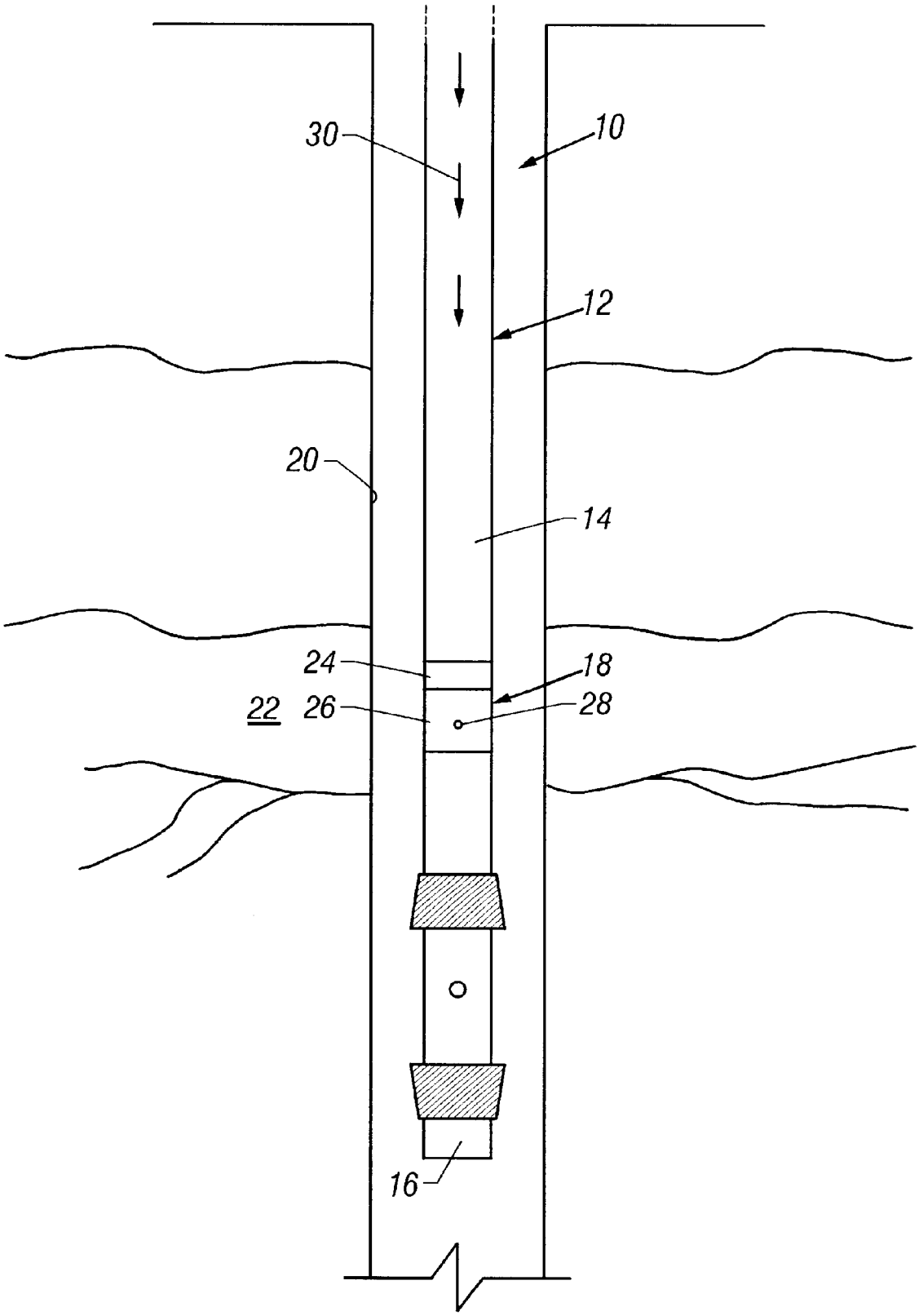
FIG. 1 is a front elevational view of an exemplary tubing and tool string disposed within a wellbore.

Referring generally to FIG. 1, an exemplary system 10 for use in a wellbore environment is illustrated. One embodiment of system 10 utilizes a tubing tool string 12 having tubing 14 and a tool or tools 16. Additionally, a disconnect 18 is deployed in tubing tool string 12 to permit, for example, emergency release of tool 16 from tubing 14 if tool 16 becomes stuck within a wellbore 20.

Tubing tool string 12 may be used in a variety of environments and applications. Typically, tubing tool string 12 is deployed downhole within wellbore 20. The exemplary wellbore 20 is formed in a subterranean formation 22 that may hold, for instance, oil or some other production fluid.

In one specific application of tubing tool string 12, tool 16 is utilized to fracture formation 22. A high pressure fluid, such as a liquid, is delivered through tubing 14 and disconnect 18 to tool 16. Tool 16 is designed to utilize the high pressure fluid in fracturing subterranean formation 22, as known to those of ordinary skill in the art. It should be noted that high pressure fluid can be delivered to a downhole location for a variety of tasks other than for the fracture of formation 22. Also, tool 16 may comprise a variety of tools, e.g. a straddle packer as illustrated in FIG. 1.

In the embodiment illustrated, tubing 14 comprises coiled tubing. However, other types of tubing also can be used. For example, conventional linear sections of tubing can be joined together and deployed within wellbore 20.

Disconnect 18 typically is connected between tool 16 at a lower end and tubing 14 at an upper end, as illustrated. However, the disconnect 18 also can be connected at other locations above tool 16 depending on the specific application, devices incorporated into the tubing tool string, etc. Generally, disconnect 18 includes an upper portion 24 and a lower portion 26 that are coupled to one another by, for example, a fracture member 28, e.g. a shear member or a tensile member. An exemplary shear member 28 includes a plurality of shear pins extending between upper portion 24 and lower portion 26. In the illustrated embodiment, upper portion 24 also is connected to tubing 14 by, for instance, threaded engagement, and lower portion 26 is connected to tool 16 by, for example, threaded engagement.

As described in more detail below, disconnect 18 is designed as a pressure compensated disconnect to protect against inadvertent shearing of shear member 28 and release of tool 16 when a high pressure fluid 30 is directed through tubing 14 and disconnect 18 to tool 16. The pressure compensated disconnect 18 also eliminates the need to design disconnect 18 such that an undesirably high disconnect load (e.g. tensile load applied to tubing 14) be applied to release tool 16.

Figure 2:
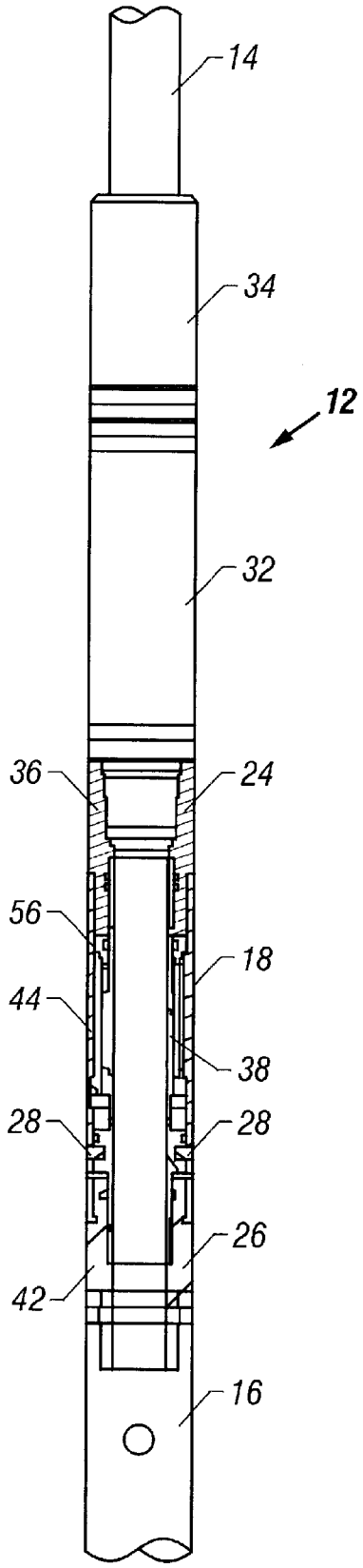
FIG. 2 is a front elevational view of an alternate embodiment of the system illustrated in FIG. 1.

Referring generally to FIG. 2, an alternate embodiment of tubing tool string 12 is illustrated. In this embodiment, disconnect 18 is coupled to tool 16 at a lower end. However, disconnect 18 is coupled to tubing 14 via a check valve 32 and a connector 34. In the exemplary embodiment, check valve 32 is disposed between disconnect 18 and connector 34. Connector 34, in turn, is connected to tubing 14. A variety of other components can be substituted or added to tubing tool string 12 depending on the environment, application and tasks to be performed. It also should be noted that in FIG. 2, an exemplary disconnect 18 is illustrated in cross-section to facilitate description of the pressure compensated device.

Figure 3:
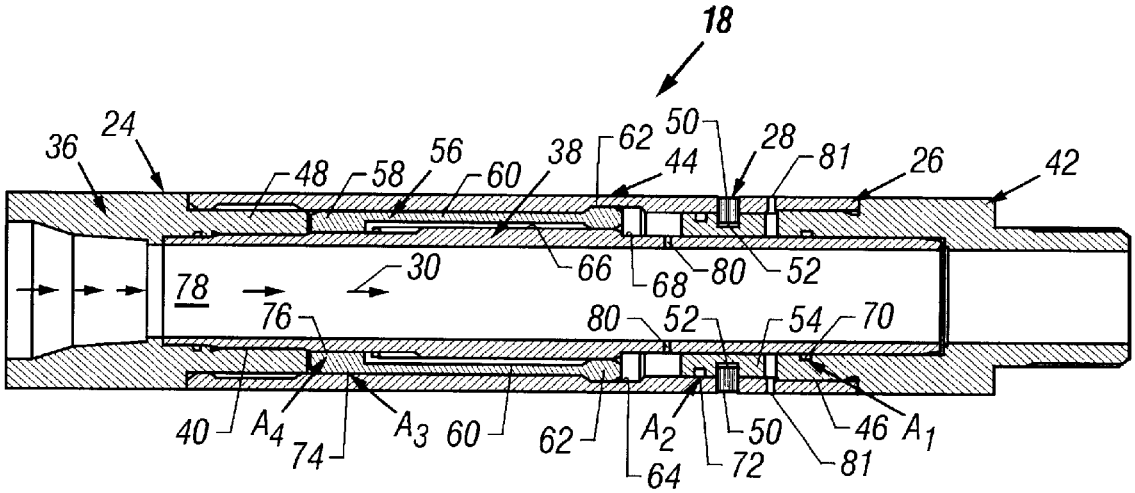
FIG. 3 is a cross-sectional view taken generally along the axis of a mechanical disconnect utilized in the system illustrated in FIGS. 1 and 2.

Referring to FIGS. 2 and 3, the exemplary, pressure compensated disconnect 18 is illustrated in cross-section. In this embodiment, upper portion 24 includes an upper sub 36 coupled to a mandrel 38 by, for example, a threaded engagement region 40. An exemplary lower portion 26, on the other hand, comprises a lower sub 42 coupled to a housing 44 by a threaded engagement region 46.

In the illustrated example, housing 44 is generally tubular and sized to receive mandrel 38 and a neck portion 48 of upper sub 36. As described above, upper portion 24 and lower portion 26 are connected by shear member 28. In the embodiment of FIGS. 2 and 3, shear member 28 comprises a plurality of shear pins 50 that extend between housing 44 and mandrel 38. However, shear member 28 may comprise a variety of other mechanisms, such as shear screws. Shear pins 50 extend through housing 44 and into corresponding openings 52 formed in an annular boss 54 of mandrel 38.

Additionally, a collet 56 is disposed between housing 44 and mandrel 38. Collet 56 includes an annular base 58 and a plurality of arms 60 extending from annular base 58 in a generally axial direction, as illustrated best in FIG. 3. An expanded region 62 is disposed at an end of each arm 60 generally opposite annular base 58. Housing 44 has a corresponding annular recess 64 for receiving expanded regions 62. Mandrel 38 comprises an external platform or raised surface 66 that securely holds each expanded region 62 in annular recess 64 when upper portion 24 and lower portion 26 are connected by shear member 28.

During, for example, an emergency release of tool 16, with housing 44 frictionally anchored to the casing 20, disconnect 18 is separated by applying a predetermined tensile load to upper portion 24 via tubing 14. When the predetermined tensile load is applied, the shear load of shear member 28, e.g. shear pins 50, is exceeded and mandrel 38 begins to move upward (to the left in FIG. 3) relative to housing 44. As the mandrel continues to move relative to the housing, expanded regions 62 move from raised surface 66 to a radially inward position in an annular recess 68 of mandrel 38. The radially inward movement of expanded region 62 is caused by collet arms 60 as they spring inward and release the collet from the annular recess 64 of housing 44. Tubing 14, upper sub 36, mandrel 38 and collet 56 are thus released, while the housing 44, lower sub 42 and tool 16 remain downhole.

Disconnect 18 is pressure compensated by creating a plurality of pressure areas sized to create counteracting, axial forces applied to upper portion 24 and lower portion 26 such that shear member 28 is not inadvertently sheared. In the exemplary embodiment, a plurality of pressure areas, e.g. pressure areas $A_1$, $A_2$, $A_3$ and $A_4$, are created at various seal points defined by seals 70, 72, 74 and 76. (See also FIG. 4). Seals 70, 72, 74 and 76 may comprise, for example, O-ring seals.

Figure 5:
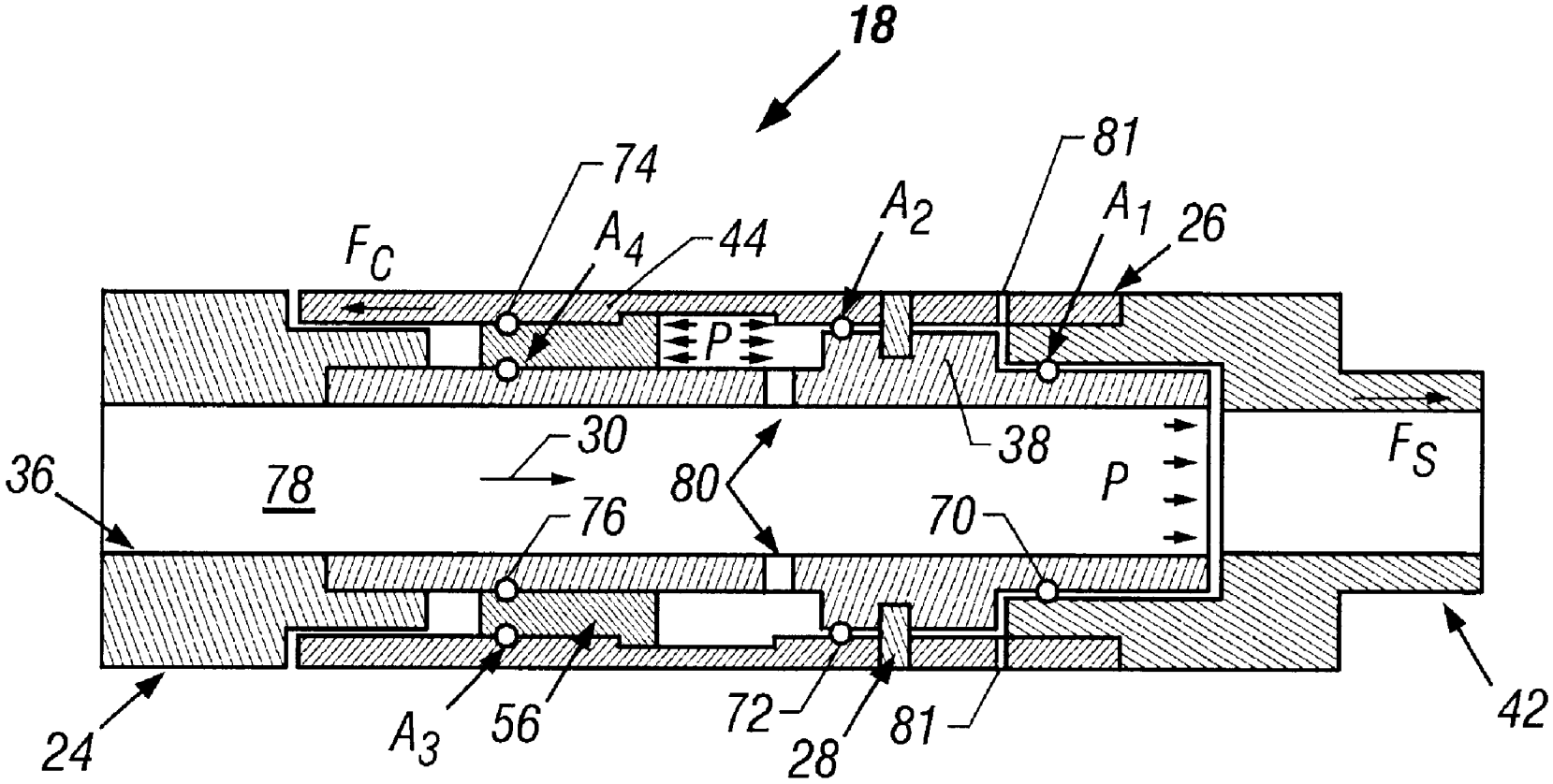
FIG. 5 is a schematic illustration of the mechanical disconnect of FIG. 3.

Referring to the schematic representation of the mechanical disconnect illustrated in FIG. 5, when a high pressure fluid 30 flows through an interior flow path 78 of disconnect 18, the fluid pressure acts against pressure areas $A_1$, $A_2$, $A_3$, and $A_4$ to create counteracting forces. In the example illustrated, the pressure (P) of fluid 30 acts against pressure area $A_1$, and specifically seal 70, in a manner that tends to separate mandrel 38 from housing 44, and thus upper portion 24 from lower portion 26. When the housing 44 is not frictionally anchored to the casing 20, the separation force ($F_S$) is equal to the differential pressure ($P_D$) across seal 70 times the pressure area $A_1$, ($F_S=P_D*A_1$). The differential pressure used to calculate the separation force is the differential pressure between the pressure (P) of fluid 30 along internal flow path 78 and the external or wellbore pressure which is communicated to the space between the mandrel 38 and the housing 44 by communication ports 81. The pressure load acting on area $A_1$, is compensated with respect to the housing 44 of lower portion 26 by exposing areas $A_2$, $A_3$, and $A_4$ to differential pressure $P_D$ via bleed passage 80. Bleed passage or passages 80 effectively expose seals 72, 74, and 76 to the differential pressure $P_D$.

Figure 4:
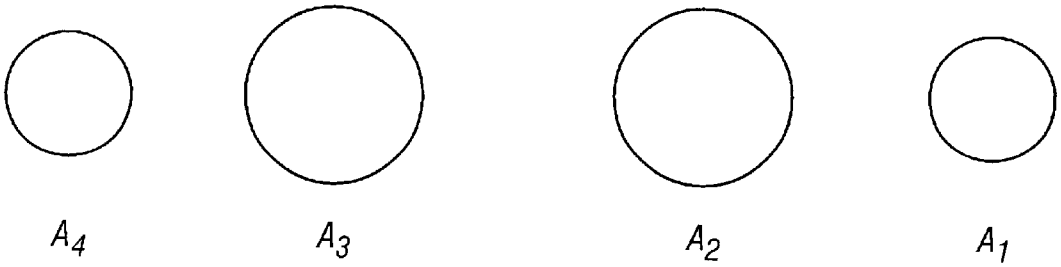
FIG. 4 is a diagrammatic illustration of the pressure areas utilized by the mechanical disconnect illustrated in FIG. 3 to pressure balance the disconnect.

In the illustrated embodiment, the separation force ($F_S$) acting on housing [44], and thus lower portion 26, is compensated by compressive force $F_C=P_D*(A_3-A_4)$ acting between seals 74 and 76, because $A_1$, equals $(A_3-A_4)$. Thus, there is no shear load acting on the shear members 28. (See also the diagrammatic illustration of FIG. 4 showing the effective areas acted on by the differential pressure). It is important to also note that, because the area $A_1$ equals $(A_2-A_4)$, the forces are balanced across the shear members 28 again resulting in no net shear load acting on the shear members 28.

In the embodiment illustrated, seals 74 and 76 are disposed around the annular base 58 of collet 56, as illustrated in FIG. 3. The compressive force $F_C=P_D*(A_3-A_4)$ acting on seals 74 and 76 is resisted by the interference between expanded regions 62 and annular recess 64 of housing 44. It should be noted that the differential pressure $P_D$ is used to determine the counteracting forces, because each seal 70, 72, 74, and 76 is exposed to external wellbore pressure on an axial side opposite the side exposed to the internal pressure of fluid 30. Thus, $P_D$ represents the differential pressure between the internal fluid pressure and the external, wellbore pressure.

It will be understood that the foregoing description is of preferred exemplary embodiments of this invention, and that the invention is not limited to the specific forms shown. For example, a variety of upper and lower portions or assemblies may be coupled together by a variety of shear members. Additionally, the size, arrangement and number of pressure areas created to establish counteracting forces can be changed from one embodiment to another depending on the application and overall design of the disconnect. These and other modifications may be made in the design and arrangement of the elements without departing from the scope of the invention as expressed in the appended claims.

What is claimed is:

1. A system for facilitating disconnection of a tool at a downhole location, comprising:

a tubing;

a tool; and a mechanical disconnect positioned to permit release of the tool from at least a portion of the tubing, the mechanical disconnect being pressure compensated to be substantially free of forces that tend to separate the disconnect and that are caused by internal pressure in the tubing.

2. The system as recited in claim 1, wherein the tubing comprises coiled tubing.

3. The system as recited in claim 1, wherein the tool comprises a straddle packer.

4. The system as recited in claim 1, wherein the mechanical disconnect comprises an upper portion coupled to a lower portion by a shear member.

5. The system as recited in claim 4, wherein the shear member comprises a plurality of shear pins.

6. The system as recited in claim 4, wherein the shear member comprises a plurality of shear screws.

7. The system as recited in claim 4, wherein the upper portion comprises an upper sub connected to a mandrel.

8. The system as recited in claim 7, wherein the lower portion comprises a lower sub connected to a housing.

9. The system as recited in claim 8, wherein the mechanical disconnect further comprises a collet disposed between the mandrel and the housing.

10. The system as recited in claim 9, further comprising a plurality of seals disposed between the upper portion and the lower portion, wherein the plurality of seals create pressure areas exposed to a relatively high internal pressure, the pressure areas being selected to pressure compensate the housing in an axial direction.

11. A mechanical disconnect for use in a downhole environment, comprising:

an upper portion;

a lower portion;

a fracture member connected between the upper portion and the lower portion; and a pressure compensation system having pressure areas exposed to a relatively high internal pressure, the pressure areas being selected to substantially balance axial forces acting on the lower portion.

12. The mechanical disconnect as recited in claim 11, wherein the pressure compensation system comprises a plurality of sealed areas sized to substantially balance axial forces acting on the lower portion.

13. The mechanical disconnect as recited in claim 12, wherein the upper portion comprises an upper sub connected to a mandrel.

14. The mechanical disconnect as recited in claim 13, wherein the lower portion comprises a lower sub connected to a housing.

15. The mechanical disconnect as recited in claim 14, wherein the mechanical disconnect further comprises a collet disposed between the mandrel and the housing.

16. The mechanical disconnect as recited in claim 12, wherein the plurality of sealed areas comprises four sealed areas exposed to an internal pressure and sized to counteract an imbalance of axial forces acting on the lower portion.

17. The mechanical disconnect as recited in claim 16, further comprising an O-ring seal at each sealed area.

18. A method for supplying a fluid under relatively high pressure to a tool disposed downhole in a wellbore, comprising:

pressurizing the fluid in a tubing disposed in a wellbore;

directing the fluid through a mechanical disconnect to the tool; and pressure compensating the mechanical disconnect to provide substantially balanced counteracting axial forces when the tool connected to the disconnect is not frictionally anchored in the casing.

19. The method as recited in claim 18, further comprising utilizing the tool to fracture a formation.

20. The method as recited in claim 12, wherein pressurizing comprises pressurizing the fluid in a coiled tubing.

21. The method as recited in claim 18, wherein pressurizing comprises pressurizing a liquid.

22. The method as recited in claim 18, further comprising forming the mechanical disconnect by connecting an inner mandrel to an outer housing via a shear member.

23. The method as recited in claim 22, further comprising exposing predetermined areas along the inner mandrel and the outer housing to the fluid.

24. The method as recited in claim 23, further comprising selecting the predetermined areas such that the pressure exerted by the fluid provides desired axial forces on the inner mandrel and the outer housing.

25. The method as recited in claim 24, wherein selecting comprises balancing the desired axial forces such that minimal shear force is exerted on the shear member due to internal pressure in the tubing.

* * * * *